United States Patent [19]

Houston et al.

[11] 4,260,297

[45] Apr. 7, 1981

[54] MACHINES FOR POSITIONING ROOF SUPPORTS IN A TUNNEL

[75] Inventors: John Houston, Prestbury; Victor P. Rigby, Bolton, both of England

[73] Assignee: Edbro Limited, Lancashire, England

[21] Appl. No.: 945,899

[22] Filed: Sep. 26, 1978

[51] Int. Cl.[3] ..... E21D 15/58; E21D 7/00

[52] U.S. Cl. ..... 405/303; 405/288; 405/146

[58] Field of Search ..... 405/151, 150, 152, 153, 405/138-143, 132, 303, 288; 414/10, 11, 728, 743, 745

[56] References Cited

U.S. PATENT DOCUMENTS

| | | | |
|---|---|---|---|
| 2,700,483 | 1/1955 | Cook et al. | 414/743 |
| 2,727,639 | 12/1955 | Ball et al. | 414/743 X |
| 3,404,920 | 10/1968 | Tabor | 405/141 X |
| 3,556,599 | 1/1971 | Fikse | 405/141 X |
| 3,828,862 | 8/1974 | Dabell et al. | 405/150 X |

FOREIGN PATENT DOCUMENTS

| | | | |
|---|---|---|---|
| 2501535 | 7/1976 | Fed. Rep. of Germany | 405/303 |
| 731567 | 6/1955 | United Kingdom . | |
| 811566 | 4/1959 | United Kingdom . | |
| 1451586 | 10/1976 | United Kingdom . | |

*Primary Examiner*—Dennis L. Taylor

*Attorney, Agent, or Firm*—Birch, Stewart, Kolasch & Birch

[57] ABSTRACT

The present invention is directed to a machine for positioning roof supports in a tunnel. The machine includes a body unit having a track engaging assembly by which the body unit may be suspended from an overhead track extending along the length of the tunnel. A drive motor is provided for impelling the body unit along the track. An arm assembly support member is mounted on the body unit for pivotal movement about a vertical axis under the control of a slewing actuator. In addition, an arm assembly is pivotally connected at one end thereof to the arm assembly support member for pivotal movement about a horizontal axis under the control of a lifting actuator. A yoke holder is mounted at the opposite end of the arm assembly so as to maintain a constant attitude during the raising and lowering of the arm assembly between a lowered position and a raised position of the arm assembly. Lastly, a yoke is provided for supporting a roof support and pivotally mounted to the yoke holder for pivotal movement about a vertical axis under the control of a pivoting actuator and control member to control actuation of the pivoting actuator and the slewing actuator so that movement of the arm assembly from a slewed position in which the arm assembly is in the lowered position and transverse to the length of the tunnel and the yoke is parallel to the length of the tunnel and adjacent a wall of the tunnel to a lifting position in which the arm assembly is in the lowered position and lies along the length of the tunnel with the yoke normal to the length of the tunnel includes two movements. One from the slewed position to an intermediate position during which the slewing actuator and the pivoting actuator are operated together to pivot the arm assembly while pivoting the yoke to maintain the yoke parallel to the length of the tunnel. A second movement is from the intermediate position to the lifting position in which the slewing actuator and the pivoting actuator are operated together to pivot the arm assembly to the lifting position while pivoting the yoke in a return movement to a position in which the yoke is normal to the length of the arm assembly. This movement of the yoke permits a roof support to be placed on the yoke in the slewed position while maintaining it out of contact with the tunnel walls during movement from the slewed position of the arm assembly to the lifting position.

18 Claims, 8 Drawing Figures

MACHINES FOR POSITIONING ROOF SUPPORTS IN A TUNNEL

BACKGROUND AND SUMMARY OF THE INVENTION

The invention relates to machines for positioning roof supports in a tunnel.

A previously proposed machine for positioning roof supports in a tunnel has comprised a wheeled base which runs along a floor of the tunnel, the base being provided with a arm pivotally mounted on the base at one end and having a holder for a roof support at the other end. A roof support mounted on the holder is raised from the ground by the arm and positioned in the roof.

It is a disadvantage of this previous proposal that the base running along the floor of the tunnel interfers with the positioning of conveyor belts in the tunnel to remove tunnelled material and also prevents easy access to a heading of the tunnel.

It is an object of the invention to mitigate these disadvantages.

Accordingly, the invention provides a machine for positioning roof supports in a tunnel and comprising a body unit including a track engaging assembly by which the body unit can be suspended from an overhead track, a drive motor for driving the body unit along the track, an arm assembly connected at one end thereof to the body unit for pivotal movement about a horizontal axis and connected at an opposite end thereof to a holder for a roof support and a lifting hydraulic actuator which acts on the arm assembly to pivot the arm assembly about said pivotal axis so that, in use, with the body unit suspended from an overhead track extending along a tunnel, the holder is movable by the lifting hydraulic actuator between a lowered position in which a roof support can be loaded onto the holder and a lifted position in which the loaded roof support is at or adjacent a tunnel roof supporting position.

A machine according to the invention has the advantage that by being suspended from an overhead track, it does not interfere with any floor mounted conveyor in the tunnel and also does not prevent easy access to the tunnel heading.

The roof support may comprise an arch crown rolled steel joist in which case the holder preferably comprises two channel members spaced on opposite sides of a vertical plane including the arm assembly, said channel members, in use, carrying the arch crown so that the arch crown lies in a plane normal to the length of the tunnel before the arm assembly is lifted.

The holder preferably includes a bucket within which a person or persons may stand. The provision of a bucket allows the roof support to be fitted in position in the roof by an operator standing in the bucket. In addition, an operator in the bucket can also undertake other tasks such as stemming and tunnel maintenance.

BRIEF DESCRIPTION OF THE DRAWINGS

The following is a more detailed description of two embodiments of the invention, by way of example, reference being made to the accompanying drawings in which.

DETAILED DESCRIPTION OF THE INVENTION

Figure 3:
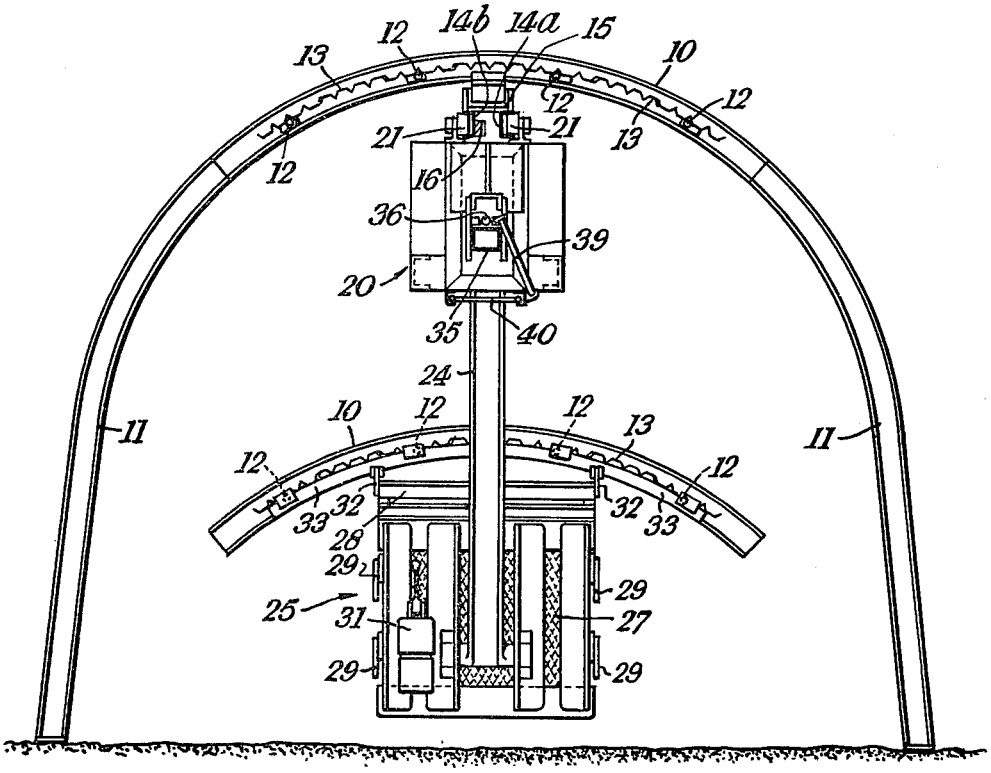
FIG. 3 is a view on the line III—III of FIG. 1.
Figure 7:
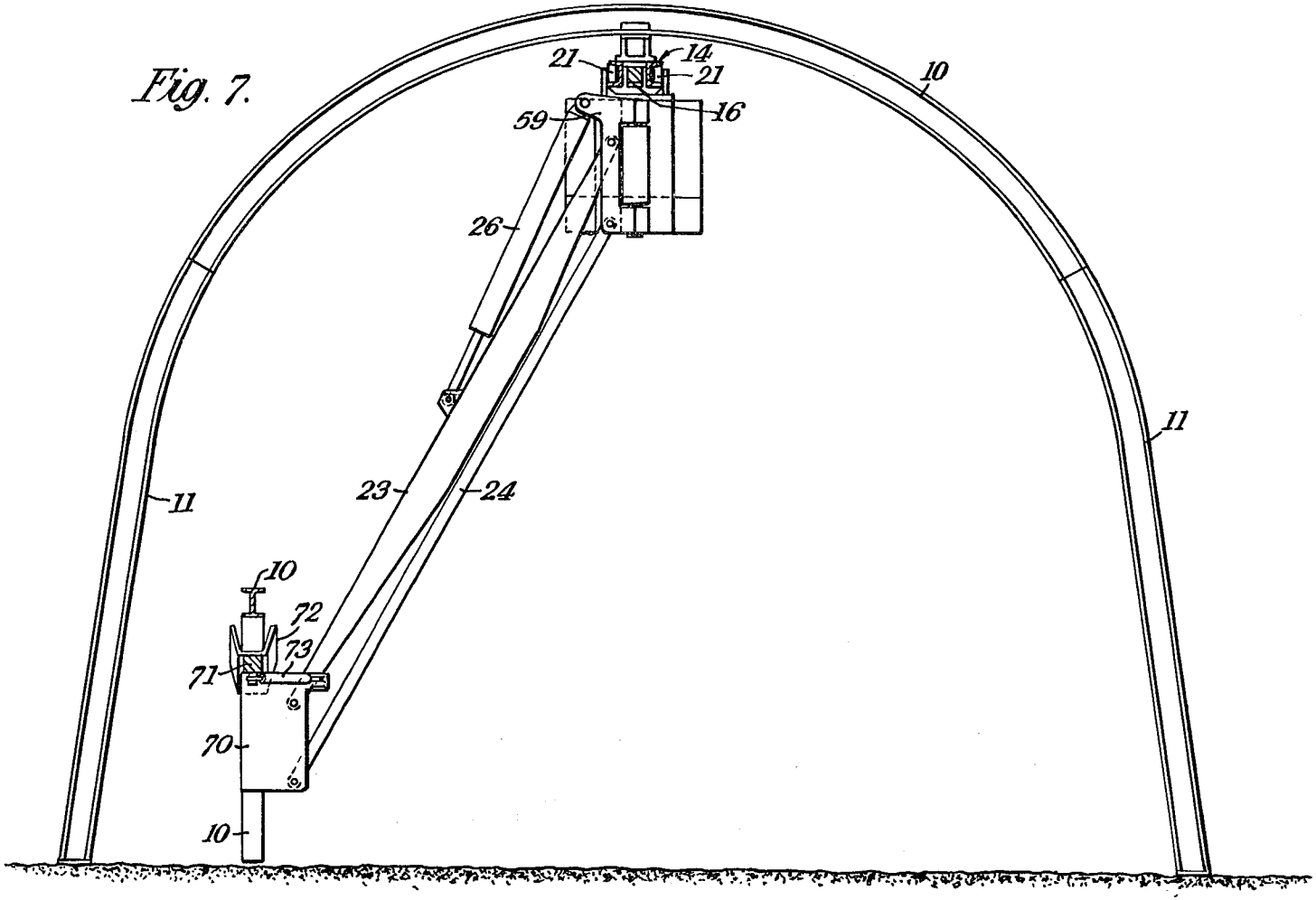
FIG. 7 is a view on the line VII—VII of FIG. 5.

Both embodiments of an arch crown lifting machine can be used in a mine tunnel having a cross-section substantially as shown in FIGS. 3 and 7. As the mine tunnel is driven, it is necessary to support and line the heading so formed. One supporting and lining system comprises the use of arch crowns which are arcuately shaped 6×5 I-section rolled steel joists and which are designated in the Figures by the reference numeral 10. When in position, each arch crown 10 lies in a plane normal to the length of the tunnel and is supported by two steel legs 11 as seen in FIGS. 3 and 7. The arch crowns 10 are spaced apart along the tunnel at a pitch of 3 feet 6 inches; the pitch being maintained by struts 12 (FIG. 1) which extend between adjacent arch crowns 10 and are angularly spaced around the arch crowns 10.

A corrugated lining sheet 13 also extends between adjacent arch crowns above the struts 12 and prevents debris falling from the tunnel roof. The space between the sheet 13 and the roof may be filled with a foamed material.

Each arch crown 10, a plurality of associated struts 12 and an associated sheet 13 are connected together as an arch crown unit. These units are connected together to form the tunnel support and lining.

A track formed from a plurality of end-to-end rails 14 is suspended from the arch crowns 10 by brackets 15, the track extending parallel to the length of the tunnel. Each rail 14 is formed from two connected but spaced parallel channel-section rolled steel joists **14*a*, 14*b* which have their flanges substantially horizontal. The joists 14*a*, 14*b* carry a gear cut rack 16 (see FIG. 2) with the teeth vertical. The brackets 15 are adjustable to allow for a degree of misalignment in height and pitch between the crown arches 10. The track extends along the centre line of the arch crowns 10** but it will be appreciated that it may be located at a lower position.

Referring now particularly to the first embodiment of FIGS. 1 to 4, this machine comprises a body unit 20 suspended from the track by two wheel assemblies 21 which engage the flanges of the rail joists **14*a*, 14*b*. A hydraulic motor 22 is carried on the body unit 20 and has an output shaft carrying a gear wheel which is in meshing engagement with the rack 16 (see FIG. 2**).

The body unit 20 includes a vertically hinged plate 59 which is connected to one end of two parallel vertically spaced arms 23, 24 by horizontal pivots. The opposite ends of the arms 23, 24 are connected by horizontal pivots to a holder 25, described in more detail hereinafter. A lifting hydraulic actuator 26 is connected between the plate 59 and the lower arm 24. The horizontal pivots are, in the position of the arms 23, 24 shown in FIG. 1, normal to the length of the tunnel.

A slewing hydraulic actuator 34 is connected at one end to the body unit 20 and at the other end to a lever arm (not shown) extending from one side of the vertically hinged plate 59. This allows the slewing hydraulic actuator 34 to slew the arms 23, 24 and the holder 25 from their central position shown in full line in FIG. 2 to the slewed positions shown in chain dotted line in FIG. 2.

The holder 25 comprises a bucket 27 for holding a person or persons and an arch crown carrier 28 connected to the remainder of the holder 25 by a double parallel arm linkage 29 which constrains the carrier 28 to move in a vertical direction only. A hydraulic actuator 30 operated by a hand pump 31 is connected between the bucket 27 and the carrier 28 to achieve this movement.

The carrier 28 comprises two channels 32 (see FIG. 3) which are spaced on opposite sides of the vertical plane including the arms 23, 24 for supporting an arch crown 10 of an arch crown unit (see FIG. 3). The struts 12 of the unit and the sheet 13 of the unit are supported by two strips 33 (see FIG. 2 and 3) which extend in a plane normal to the length of the tunnel in the position of the holder 25 shown in FIGS. 1 and 3. The carrier 28 also includes a rail support 58 for a purpose to be described hereinafter.

The body unit 20 includes a beam 35 cantilevered from the trailing end of the body unit opposite the arms 23, 24. One end of the beam 35 is mounted on the body unit 20 for pivotal movement about a horizontal axis which is normal to the length of the tunnel by means of a hydraulic actuator 36 operated by a hand pump 37. The other, free, end of the beam 35 carries a clamp 38 for clamping a rail 14 of the track to the beam 35 (see FIG. 1). Thus a rail 14 of the track disconnected from its associated brackets 15 and its adjacent rails 14 can be lowered to the chain-dotted position shown in FIG. 1 to dismantle the track behind the machine. From this position, the rail 14 can be released from the clamp 38 and removed.

Figure 1:
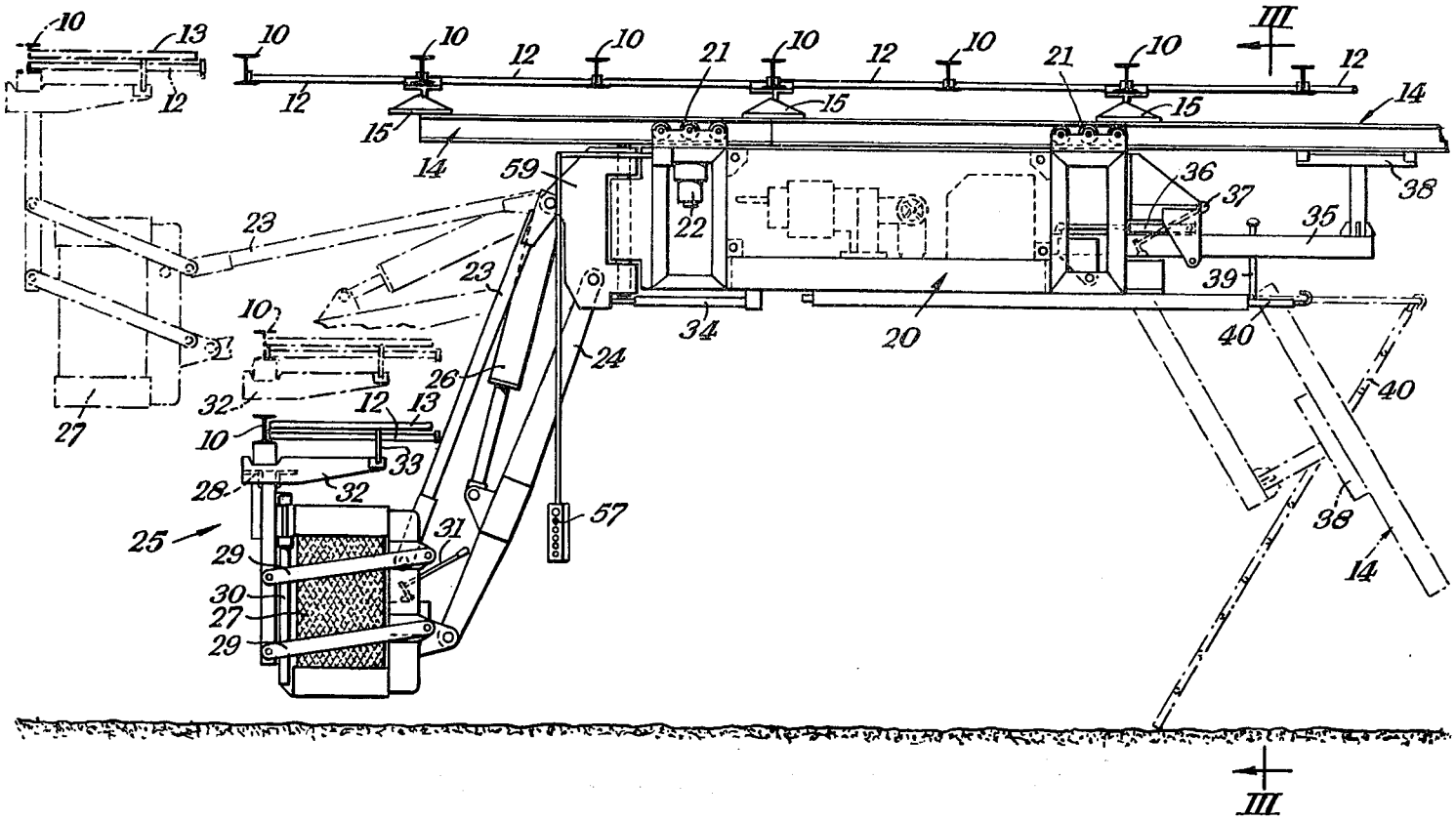
FIG. 1 is a side elevation of a first embodiment of an arch crown positioning machine.
Figure 2:
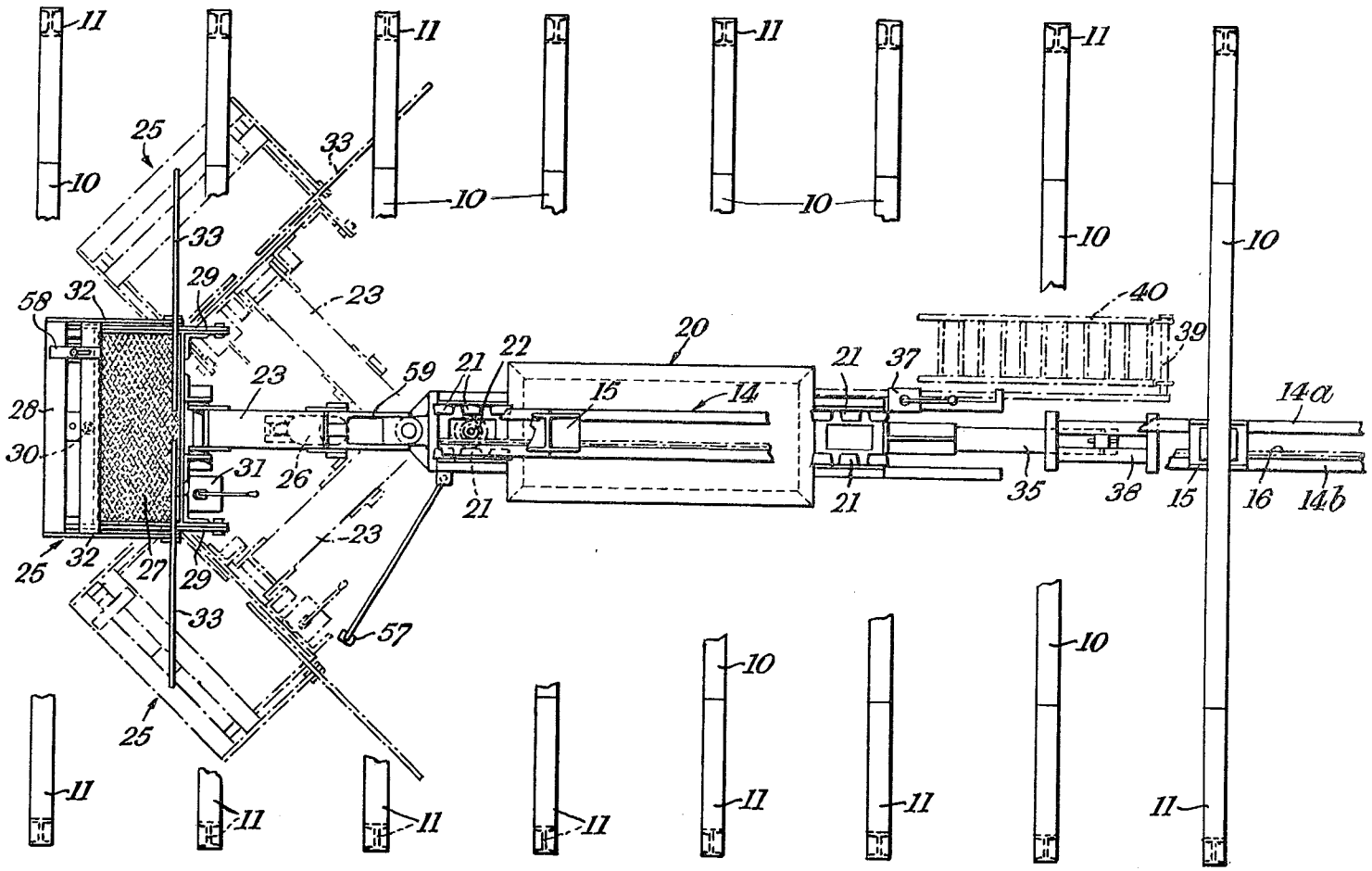
FIG. 2 is a plan view from above of the arch crown positioning machine of FIG. 1.

At the trailing end of the body unit 20 is an arm 39 and a ladder 40 which are shown in their stowed positions in full line in FIGS. 1, 2 and 3 and in their operative positions, to give access to the rail 14 and the clamp 38, in chain-dotted line in FIGS. 1 and 2.

Figure 4:
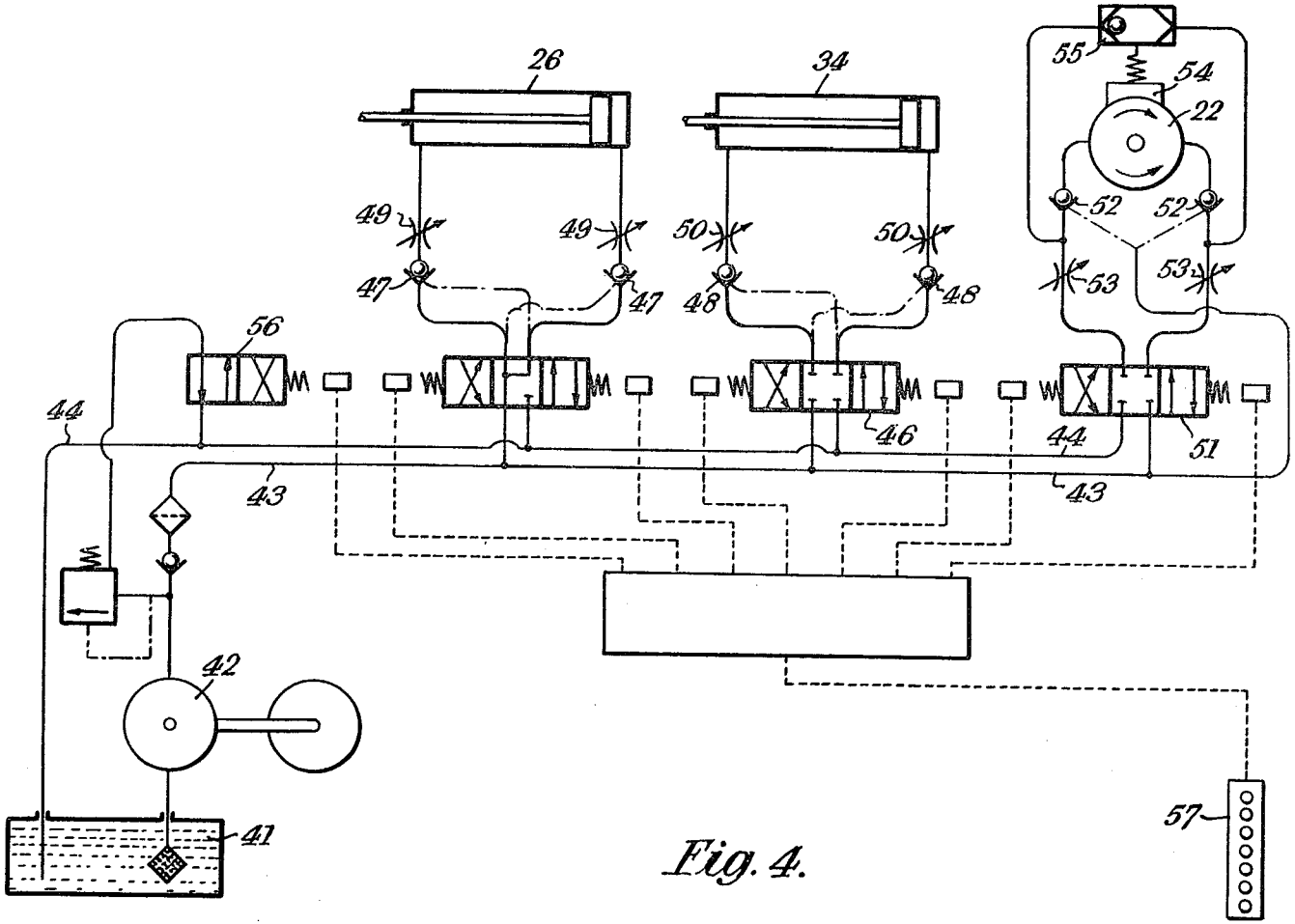
FIG. 4 is a diagram of a control system for the arch crown positioning machine of FIGS. 1 to 3.

Referring next to FIG. 4, a control system for the lifting hydraulic actuator 26, the slewing hydraulic actuator 34 and the hydraulic motor 22 is provided in the body unit. The control system comprises a reservoir 41 of hydraulic fluid fed by a pump 42 to a pressure line 43 and returned through a return line 44 to the resevoir 41. The lifting hydraulic actuator 26 and the slewing hydraulic actuator 34 are both double acting and their connection to the pressure line 43 and the return line 44 is controlled by respective solenoid operated directional control valves 45, 46 fitted with pilot operated check valves 47, 48. Their speed of movement is controlled by respective fixed orifices 49, 50 to a desired value.

The hydraulic motor 22 is reversible and is connected to the pressure line 43 and the return line 44 through a solenoid operated directional control valve 51 fitted with pilot operated check valves 52. The speed of the motor is controlled by associated fixed orifices 53. A brake 54 for the motor 22 is normally on to prevent operation of the motor 22. When, however, oil is supplied to the motor 22 for traction purposes oil under pressure is supplied to a brake release mechanism 55 which releases the brake 54, removal of said pressure returning the brake 54 to the fully on position. Cross line relief valves are also incorporated into the hydraulic motor circuit to ensure a "failsafe" condition if the brake 54 fails.

A solenoid operated valve 56 is provided to enable the whole system to be halted.

The solenoids of the lifting actuator valve 45, the slewing actuator valve 46, the motor valve 51 and the stop valve 56 are each controlled by an associated button on a pendant control 57 which hangs from the body unit 20 as shown in FIGS. 1 and 2. The pendant control 57 can be moved adjacent the bucket 27 so that a person in the bucket 27 can operate the buttons.

The machine of FIGS. 1 to 4 is operated in the following manner to position an arch crown unit at or adjacent a roof supporting position. By use of the pendant control 57, the arms 23, 24 together with the holder 25 are moved to the central lowered position shown in full line in FIG. 1 and in FIG. 3. An arch crown unit is then placed on the carrier 28 with the arch crown 10 supported by the channels 32 and the struts 12 and the sheet 13 supported by the strips 33.

The hand pump 31 is then used to operate the hydraulic actuator 30 and lift the carrier 28 to the chain-dotted position shown in FIG. 1 to enable an operator to get into the bucket 27. The operator is protected from falling debris by the sheet 13 which covers the bucket 27. This makes the use of horseheads unnecessary.

The operator then operates the pendant control 57 to lift the bucket 27 and carrier 28 to the lifted position shown in chain-dotted line in FIG. 1. In this position, the operator can bolt the struts 12 of the arch crown unit to the previously set arch so that the arch crown unit is cantilevered from the previously set arch. The operator next lowers the bucket 27 and slews the bucket 27 to the chain dotted positions shown in FIG. 2 to fit fish plates to the vertical legs 11, thus completing the arch. The holder 25 can be lifted above the level of the body unit 20 to accommodate gradients of up to 1 in 4.

The space between the sheets 13 and the roof of the tunnel can be filled by a suitable foam piped under pressure and applied from the ground or from the bucket.

When sufficient arches have been positioned, it is necessary to extend the track to allow the body unit 20 to be moved forward to lift further arch crown units. To extend the track, an operator in the bucket 27 lifts himself to the roof to fit rail clamps and brackets to the arch crown 10 along their centre line. The operator then lowers the bucket 27 and a rail 14 complete with brackets is clamped on the rail support 58 before the bucket 27 is raised again to the roof. The operator then uses the hand pump 31 to raise the carrier 28 and thus the rail 14 to a position in which the rail brackets can be connected to the crown arch brackets to locate the rail 14 in alignment with the remainder of the track. The rail 14 can then be released from the rail support 58 and the bucket 27 and operator returned to the ground.

The removal of rails 14 using the beam 35, clamp 38 and ladder 40 has already been described above.

It will be appreciated that the machine may also be used for stemming, maintenance and other operations in a mine or other tunnel.

Referring next to the second embodiment shown in FIGS. 5 to 8, parts common to this embodiment and the first embodiment of FIGS. 1 to 4 operate in the same way in both embodiments, are given the same reference numerals in both sets of Figures and will not be described in detail.

Figure 5:
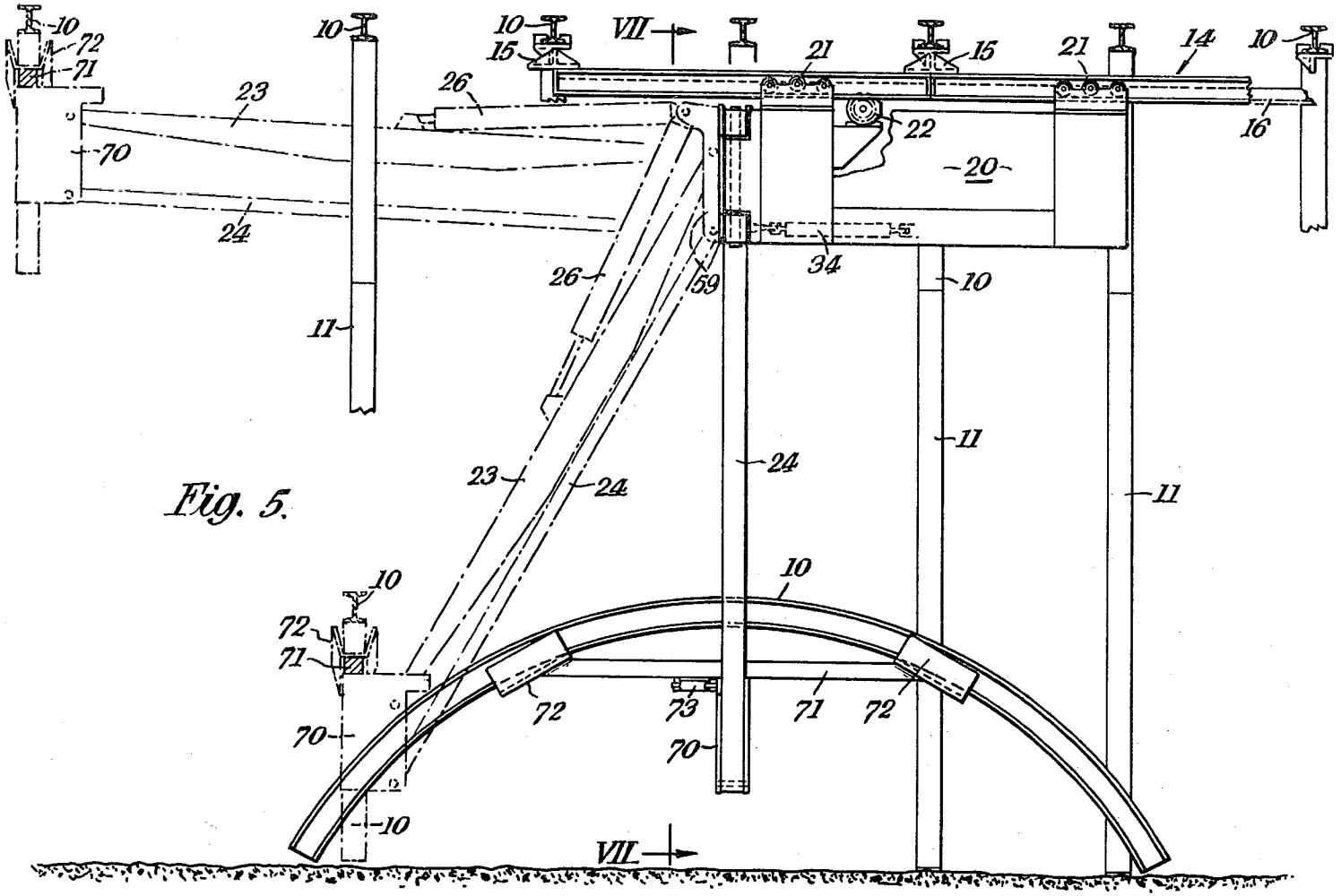
FIG. 5 is a side elevation of a second embodiment of an arch crown positioning machine.

In this embodiment, the lifting hydraulic actuator 26 is connected between a lug on the upper arm 23 and the plate 59 (see FIG. 5).

A mounting 70 forming a holder is carried on the ends of the arms 23, 24 remote from the body unit 20 and the arms 23, 24 are connected thereto by respective horizontal pivotal connections. A yoke 71 is carried by the mounting 70 for pivotal movement relatively thereto about a vertical axis and is provided with two channel shaped carriers 72 spaced on the yoke 71 on opposite sides of the vertical pivot. The yoke 71 is horizontal and the channels of the carriers 72 are co-planar with the yoke but inclined to the horizontal as best seen in FIG. 5.

Figure 6:
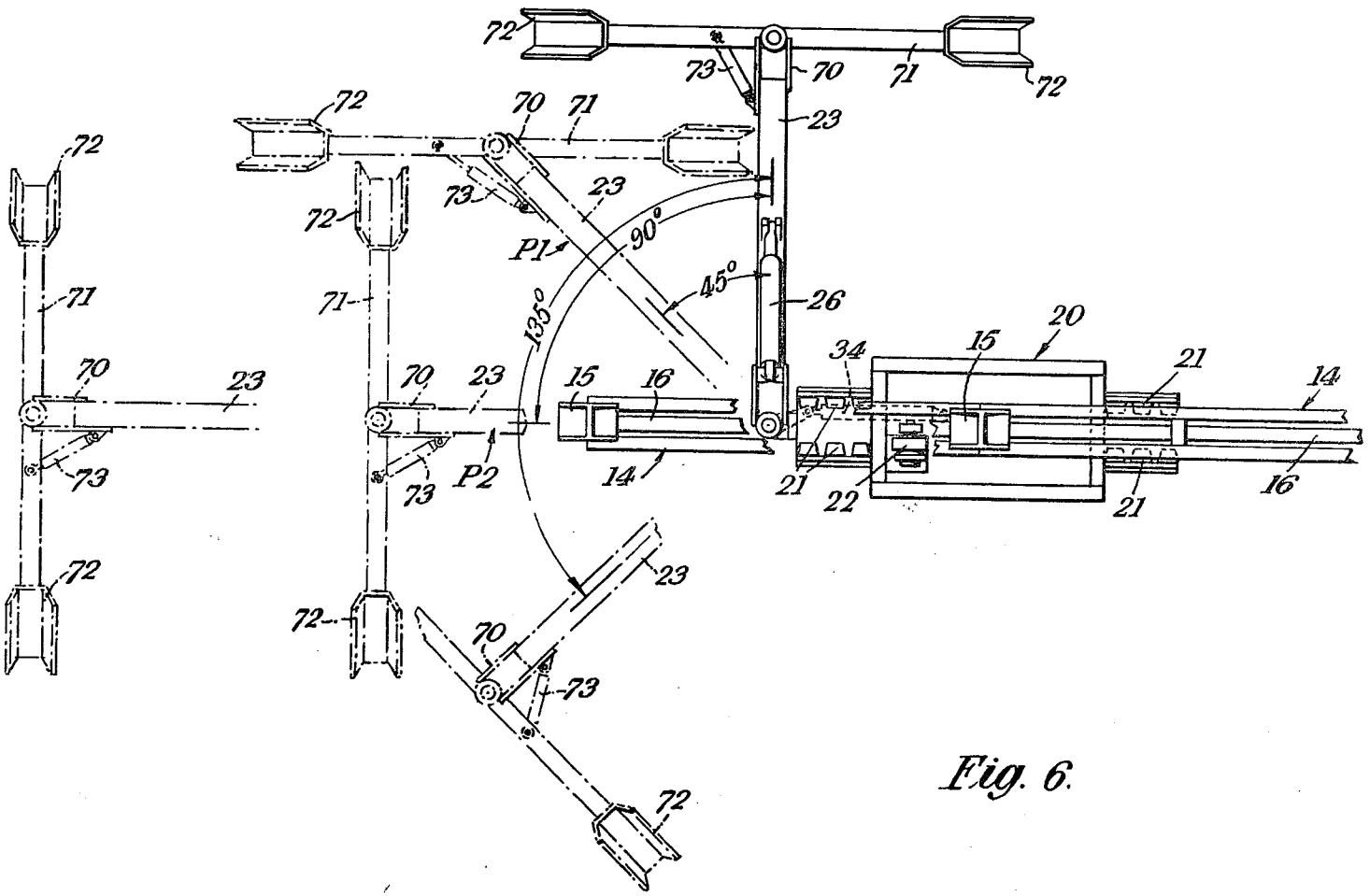
FIG. 6 is a plan view from above of the arch crown positioning machine of FIG. 5.

A pivoting hydraulic actuator 73 is, as best seen in FIG. 6, connected between the mounting 70 and a point on the yoke 71 spaced to one side of the vertical pivotal connection between the yoke 71 and the mounting 70.

Figure 8:
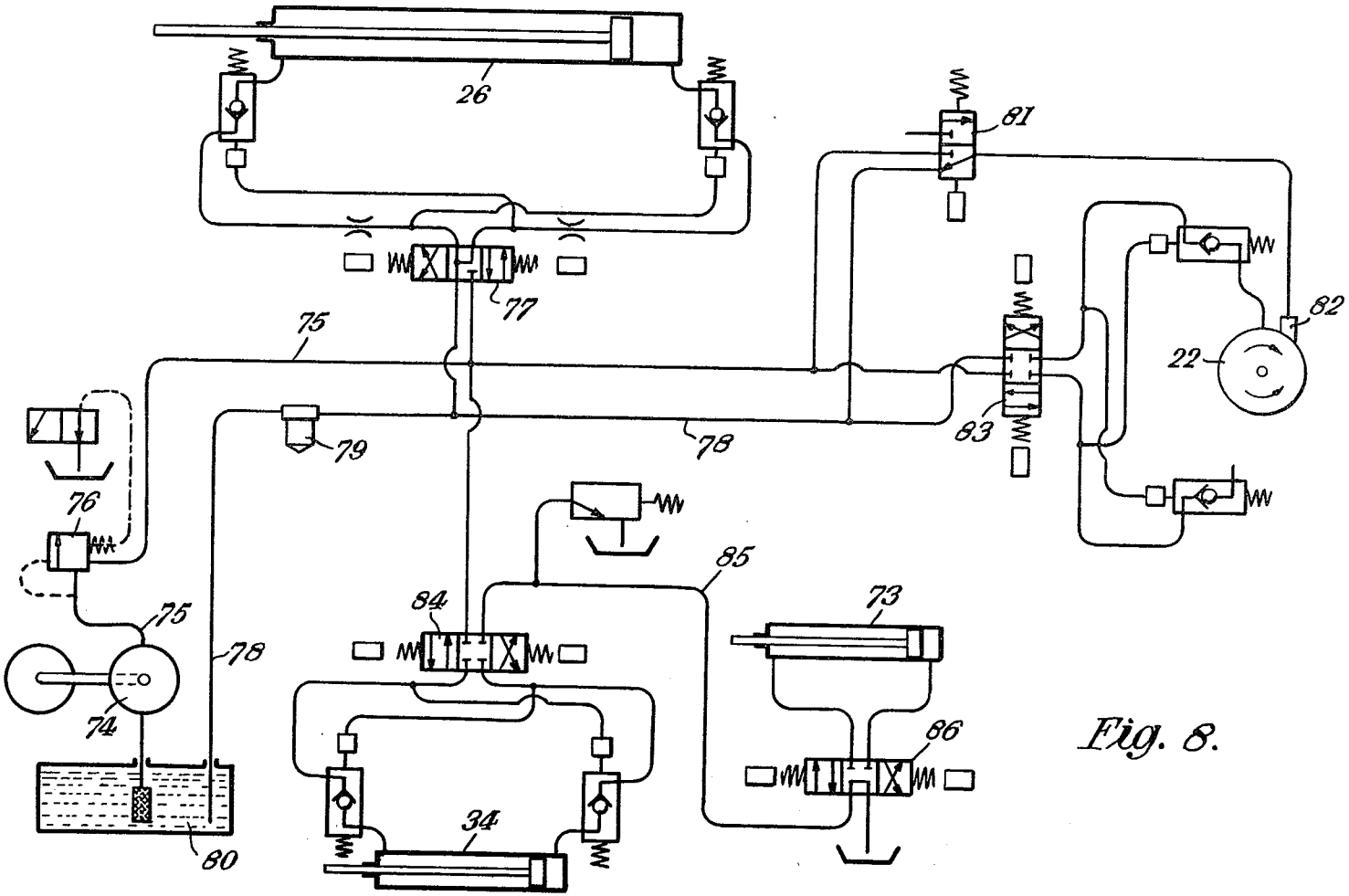
FIG. 8 is a diagram of a control system for the arch crown positioning machine of FIGS. 5 to 7.

The lifting hydraulic actuator 26, the slewing hydraulic actuator 34, the pivoting hydraulic actuator 73 and the hydraulic motor 22 are controlled by a control system shown in FIG. 8. Referring to this figure, hydraulic fluid under pressure is supplied by a pump 74 along a hydraulic pressure line 75 provided with a relief valve 76 to control the pressure of the fluid. The hydraulic pressure line 75 leads to a first directional control valve 77 for the lifting hydraulic actuator 26. The first directional control valve 77 is operated by actuation of solenoids to extend or retract a piston of the lifting hydraulic actuator 26. A return for hydraulic fluid is provided through a return line 78 which passes to a filter 79 before discharging into a reservoir 80.

The pressure line 75 also leads to a solenoid operated pilot valve 81 which controls a brake 82 acting on the hydraulic motor 22. The pilot valve 81 is such that the brake 82 is normally held on and requires actuation of a solenoid of the pilot valve to release the brake 82. The pressure line 75 also leads to a second directional control valve 83 for controlling the hydraulic motor 22. The second directional control valve 83 is controlled by two solenoids, actuation of one of which causes the hydraulic motor 22 to rotate in one direction, and actuation of the other of which causes the hydraulic motor 22 to rotate in an opposite direction. The return line 78 leading to the reservoir 35 received hydraulic fluid from both the pilot valve 81 and the second directional control valve 83.

The pressure line 75 also leads to a third directional control valve 84 which controls the operation of the slewing hydraulic actuator 34. The third directional control valve 84 is operated by two solenoids, actuation of one of which causes a piston of the slewing hydraulic actuator 36 to extend and actuation of the other of which causes the piston to retract. The return from the third directional control valve 84 passes along a line 85 to a fourth directional control valve 86 which controls the pivoting hydraulic actuator 73. The fourth directional control valve 86 is operated by two solenoids, actuation of one of which causes a piston of the pivoting hydraulic actuator 73 to extend and actuation of the other of which causes the piston of the pivoting hydraulic actuator 73 to retract. It will be appreciated that operation of the pivoting hydraulic actuator 73 is dependent on operation of the slewing hydraulic actuator 34 and this interpendence will be described in more detail below.

The control system is mounted on the body unit 20 and is operated by a pendant push button control (not shown) hanging from the body unit 20 for operation by a person standing in the tunnel.

This second embodiment can be used to collect arch crowns 10 from a stack remote from the heading and then position them at the heading. This is achieved in the following way.

The pendant control is used to rotate the motor 22 to position the body unit 20 along the track for collection of the next arch crown joist 10 to be placed in the tunnel. The pendant is then used to move the arms 23, 24 and the yoke 71 to a slewed position shown in full line in FIGS. 5, 6 and 7 in which the arms 23, 24 are in a lowered position and in which the yoke 71 is parallel to the length of the tunnel. In this starting position, an arch crown 10 can be lifted on to the yoke 71 so that the joist 10 is held in the carriers 72, as shown in FIGS. 1 and 3.

In order to prevent the arch crown 10 interfering with the side walls of the tunnel when the arms 23, 24 are moved away from this starting position, the control of the solenoids of the third directional control valve 84 is sequenced with the control of the solenoids of the fourth directional control valve 86. This sequencing is such that after an arch crown 10 is loaded on to the yoke 71, operation of the machine from the control station causes the slewing hydraulic actuator 34 and the pivoting hydraulic actuator 73 to operate together so that the slewing hydraulic actuator 73 rotates the arms 23, 24 about their vertical pivotal connection on the body unit 22 and the pivoting hydraulic actuator 73 pivots the yoke 71 about its vertical pivotal connection on the mounting 70 so that the yoke remains substantially parallel to the length of the tunnel thus preventing the arch crown 10 interfering with the side wall. This movement continues until the slewing hydraulic actuator 34 has pivoted the arms 23, 24 through an angle of 45° to the position shown in chain-dotted lines in FIG. 6 and designated as P1, in which position the piston of the pivoting hydraulic actuator 73 is fully extended. After this first intermediate position P1, the sequence is such that the solenoid of the fourth directional control valve is operated to reverse the supply of hydraulic fluid to the pivoting hydraulic actuator 73 and thus, during continued slewing rotation of the arms 23, 24 by the slewing hydraulic actuator 34, the yoke 71 makes a return rotation relatively to the mounting 70 so that when the arms 23, 24 have been rotated through 90° and are substantially co-planar with the track the yoke 71 is substantially normal to the arms 23, 24 and the piston of the pivoting hydraulic actuator 73 is substantially retracted. This central position is shown in chain-dotted lines in FIG. 6, is designated P2 and is also shown in FIG. 5 in chain-dotted lines. This sequence of control of the third and fourth directional valves 84, 86 can be controlled by suitably positioned microswitches (not shown).

The sequence is also such that further slewing of the arms 23, 24 by the slewing hydraulic actuator 34 beyond the central position P2, up to a maximum slewing rotation of 135° from the slewed position, will cause no further operation of the solenoids of the fourth directional control valve 86 and thus no further pivoting movement of the yoke 71.

The pendant control is then used to actuate the lifting hydraulic actuator 26 and raise the arms 23, 24 until the arch crown 10 is lifted into a position in which the arch crown joist and the body unit 20 can be moved along the track by actuation of the hydraulic motor 22 to a location suitable for positioning the arch crown 10 in the roof of the heading.

The pendant control is then used to complete the lifting of the arms 23, 24 to a lifted position in which the arch crown 10 can be supported on legs 11 in a desired position in the roof of the tunnel.

The pendant control is next operated to reverse the sequence of operations to return the arms 23, 24 and the yoke 71 to the slewed position. A further arch crown 10 can then be loaded onto the yoke 71 and positioned in the roof of the tunnel.

The lifting hydraulic actuator 26 can raise an arch crown 10 to a position in which the arch crown 10 is higher than previous arches. This is to allow for the placement of arch crowns 10 in an uphill section of a tunnel.

The following comments apply both to the first embodiment and to the second embodiment.

It will be appreciated that whether the slewing hydraulic actuator 34 is mounted on the right hand side or the left hand side of the body unit 20 will be determined by the positioning of other equipment such as a belt conveyor in the tunnel. Whether slewing is right handed or left handed, the total movement from the slewed position at right angles to the track is through 135°.

It will be appreciated that not all headings are of the same size. Accordingly, the provision of arms 23, 24 of one length only is not sufficient. FIGS. 1 to 3 and 5 to 7 show arms which are 12 feet long between the respective pivot points on the body unit 22 and the holder 25. Such arms are suitable for a maximum tunnel size of 22 feet wide and 16 feet high. However, heading sizes may be as small as 12 feet wide and 10 feet high and in this case, arms of 7 feet 9 inches in length between centres may be provided.

The yoke 71 can also carry a bucket (not shown) of the kind shown in FIGS. 1 to 3 which is connected to the yoke 71 by two clips of inverted U-shape which embrace the yoke 71 on opposite sides of the pivot point of the yoke on the mounting 70. The bucket can accommodate up to two people who can stand safely in the bucket and complete the securing of legs 11 to an arch crown 10 that has just been set. Alternatively, a person or persons carried in the bucket can line the tunnel between the arch crowns with various materials such as timber or metal mesh and perform any other operations connected with the roof of the tunnel which may be necessary as described above with reference to FIGS. 1 to 4.

Alternatively, a person or persons standing in the bucket can charge and stem holes that have been drilled for fixing shots.

The bucket can also be provided with a rail support by which the track can be extended along the tunnel as the tunnel is advanced as also described above with reference to FIGS. 1 to 4.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What we claim is:

1. A machine for positioning roof supports in a tunnel and comprising:

a body unit including a track engaging assembly by which the body unit can be suspended from an overhead track extending along the tunnel;

a drive motor for driving the body unit along the track;

an arm assembly support member mounted on the body unit for pivotal movement about a vertical axis under the control of a slewing actuator;

an arm assembly pivotally connected at one end to the arm assembly support member for pivotal movement about a horizontal axis under the control of a lifting actuator;

a yoke holder so mounted at the opposite end of the arm assembly as to maintain a constant attitude during the raising and lowering of the arm assembly between a lowered position and a raised position of the arm assembly; and a yoke for supporting a roof support and pivotally mounted on the yoke holder for pivotal movement about a vertical axis under the control of a pivoting actuator and control means to control actuation of the pivoting actuator and the slewing actuator so that movement of the arm assembly from a slewed position in which the arm assembly is in the lowered position and transverse to the length of the tunnel and the yoke is parallel to the length of the tunnel and adjacent a wall of the tunnel to a lifting position in which the arm assembly is in the lowered position and lies along the length of the tunnel with the yoke normal to the length of the tunnel includes a movement from the slewed position to an intermediate position during which the slewing actuator and the pivoting actuator are operated together to pivot the arm assembly while pivoting the yoke to maintain the yoke parallel to the length of the tunnel and a movement from the intermediate position to the lifting position in which the slewing actuator and the pivoting actuator are operated together to pivot the arm assembly to the lifting position while pivoting the yoke in a return movement to a position in which the yoke is normal to the length of the arm assembly whereby a roof support placed on the yoke in said slewed position is kept clear of the tunnel walls during movement from the slewed position of the arm assembly to the lifting position.

2. A machine according to claim 1, wherein the slewing actuator and the pivoting actuator are hydraulic actuators and wherein the pivoting of the yoke relatively to the arm assembly during the movement of the arm assembly between the slewed position and the lifting position being effected by hydraulically coupling the slewing hydraulic actuator and the pivoting hydraulic actuator, the pivoting hydraulic actuator receiving hydraulic fluid from the slewing hydraulic actuator that the pivoting hydraulic actuator operates in one direction during movement of the arm assembly by the slewing hydraulic actuator between the slewed position and the intermediate position and operates in an opposite direction during movement of the arm assembly between the intermediate position and the lifting position.

3. A machine according to claim 1, wherein the arm assembly comprises two parallel vertically spaced arms, each arm being connected at one end thereof to the arm assembly support member and at an opposite end thereof to the yoke holder for pivotal movement about horizontal axes thereby to maintain the yoke holder at said constant attitude during movement of the arm assembly between the lowered and raised positions.

4. A machine according to claim 1, wherein the holder includes a mounting for a rail of the track so that a rail secured to the mounting with the holder in the lowered position can be lifted by the holder and positioned in alignment with the track for fixing to extend the track.

5. A machine according to claim 1, wherein the holder includes a bucket to accommodate at least one standing person.

6. A machine according to claim 5, wherein the bucket is releasably secured to the holder.

7. A machine according to claim 1, wherein the body unit includes a beam extending from a trailing end of the body unit, one end of the beam being mounted on the body unit for pivotal movement about a horizontal axis which is normal to the length of the tunnel by a hydraulic actuator and an opposite end of the beam carrying a clamp for clamping a rail of the track to the beam whereby a rail of the track freed from its mounting in the track can be lowered from the track to dismantle the track.

8. A machine according to claim 1, wherein the track engaging assembly comprises two sets of wheels spaced apart along the length of the body unit and suspending the body unit for movement along the track, the drive motor comprising a toothed wheel for engagement with a rack on the track to drive the body unit along the track.

9. A machine for positioning roof supports in a tunnel comprising:

a body unit including a track engaging assembly by which the body unit can be suspended from an overhead track;

a drive motor for driving the body unit along the track;

an arm assembly connected at one end thereof to the body unit for pivotal movement about a horizontal pivotal axis and connected at an opposite end thereof to a holder for a roof support; and a lifting hydraulic actuator which acts on the arm assembly to pivot the arm assembly about said pivotal axis so that with the body unit suspended from an overhead track extending along a tunnel the holder is movable by the lifting hydraulic actuator between a lowered position in which a roof support can be loaded onto the holder and a raised position in which the roof support is at or adjacent a tunnel roof supporting position;

said holder including a bucket to accommodate at least one person and a carrier for a roof support, said carrier being connected to said holder by a parallelogram linkage, and said carrier being movable from a lowered position on said holder to a raised position on said holder for locating a roof support in a roof supporting position when the arm assmebly is in the raised position.

10. A machine according to claim 9 wherein the arm assembly comprises two parallel vertically spaced arms, both arms being connected at one end thereof to the body unit and at an opposite end thereof to the holder for pivotal movement about horizontal axes so that a roof support carried on the holder maintains a constant attitude during movement between the lowered and lifted positions.

11. A machine according to claim 9 or 10, wherein the arm assembly is connected to a vertically hinged part of the body unit arranged at or towards one end of the body unit, said vertically hinged part being pivotable by a slewing hydraulic actuator to pivot the holder about said vertical pivot in a horizontal plane.

12. A machine according to claim 11, wherein the slewing hydraulic actuator being connected to the vertically hinged part by a lever arm extending from one side of the vertically hinged part whereby the slewing hydraulic actuator can slew the vertically hinged part, the arm assembly and the holder to one side or the other of a central position in which the arm assembly lies along the length of the tunnel.

13. A machine according to claim 11, wherein the body unit includes a control system for controlling the lifting hydraulic ram, the slewing hydraulic actuator and the motor, the control system having a manually operable control means for controlling the lifting and lowering of the holder, slewing of the holder and movement of the body unit along the track.

14. A machine according to claim 13, wherein the control means depends on a cable from the body unit mounted on the track.

15. A machine according to claim 9, wherein the roof support comprises an arch crown rolled steel joist, and said holder comprises two channel members spaced on opposite sides of a vertical plane including the arm assembly, said channel members carrying the arch crown so that the the arch crown lies in a plane normal to the length of the tunnel before the arm assembly is lifted.

16. A machine according to claim 15, wherein each arch crown has a plurality of spacing struts extending therefrom at spaced locations therearound, the spacing struts, in use, spacing the arch crown from the next adjacent arch crown along the length of the tunnel, wherein the holder further comprises supports for said struts.

17. A machine according to claim 15, wherein each arch crown has an arcuate lining sheet extending therefrom which covers the tunnel roof between adjacent arch crowns, and wherein the holder further comprises supports for said sheet.

18. A machine according to claim 9, wherein the carrier is lifted by means of a hydraulic actuator connected between the carrier and the remainder of the holder.

* * * * *